United States Patent [19]

Andrews

[11] Patent Number: 4,773,192

[45] Date of Patent: Sep. 27, 1988

[54] BUILDING STRUCTURES

[75] Inventor: James E. Andrews, Rugby, England

[73] Assignee: Ayrshire Metal Products (Daventry) Ltd., Daventry, England

[21] Appl. No.: 85,266

[22] Filed: Aug. 11, 1987

Related U.S. Application Data

[63] Continuation of Ser. No. 694,429, Jan. 24, 1985, abandoned.

[30] Foreign Application Priority Data

Jan. 26, 1984 [GB] United Kingdom ..... 8402027

[51] Int. Cl.[4] ..... E04C 3/30; E04C 3/40; E04B 1/32; E04B 1/58

[52] U.S. Cl. ..... 52/90; 52/639; 52/729; 403/170; 403/295

[58] Field of Search ..... 52/90, 93, 639, 721, 52/729, 641, 642, 640; 403/295, 170, 188

[56] References Cited

U.S. PATENT DOCUMENTS

| | | | |
|---|---|---|---|
| 649,352 | 5/1900 | Rector | 52/639 |
| 1,893,636 | 1/1933 | Ridgway | 52/721 |
| 2,180,317 | 11/1939 | Davis | 52/639 |
| 3,184,012 | 5/1965 | Fujishima et al. | 52/639 |
| 3,785,108 | 1/1974 | Satchell | 52/641 |
| 3,786,612 | 1/1974 | Baker | 52/639 |
| 4,078,341 | 3/1978 | Peterson et al. | 52/90 |
| 4,342,177 | 8/1982 | Smith | 403/188 |
| 4,551,957 | 11/1985 | Madray | 403/170 |

FOREIGN PATENT DOCUMENTS

| | | | |
|---|---|---|---|
| 150970 | 8/1985 | European Pat. Off. | 52/639 |
| 833697 | 12/1952 | Fed. Rep. of Germany | 403/295 |
| 2103328 | 2/1983 | United Kingdom | 403/401 |

*Primary Examiner*—Carl D. Friedman
*Assistant Examiner*—Michael Safavi
*Attorney, Agent, or Firm*—Gottlieb, Rackman & Reisman

[57] ABSTRACT

A fixing bracket 5 in a roof construction is a metal sheet with two parallel grooves 39, 40 pressed therein to protrude as ribs from the other side of the sheet. each groove extending from one edge of the sheet to another with two straight end portions and a central part-circular central portion. The outer edge of the sheet is concentrically part-circular and the inner edge is folded up at 38. Such a bracket, or a pair of such brackets back-to-back with grooves 39, 40 protruding, can connect cold-rolled channels 1,2 e.g. as used for the uprights or rafters of a portal frame structure, with compatible longitudinal base grooves. The channels are again usually used in back-to-back pairs and the brackets are bolted within these back-to-back pairs of channels. The included angle can be from 90°-135° for eaves brackets, or from 90°-180° for ridge brackets.

12 Claims, 3 Drawing Sheets

BUILDING STRUCTURES

This application is a continuation of application Ser. No. 694,429 filed 1/24/85 abandoned.

This invention relates to building structures and to their fabrication from cold-rolled steel profiles.

In particular it relates to (a) an ancillary fixing member facilitating the erection of low-cost portal-frame structures (i.e. with no internal supports), the component parts of which, such as side support columns, side rails, rafters, and purlins, are fabricated from essentially one type of rolled steel profile, and (b) the structures so erected.

There is known under the Trade Mark SWAGEBEAM a generally channel-shaped profile the base of which is strengthened by two parallel rolled grooves (giving convex ribs within the channel) and the side walls of which are rolled inwards at 90° at their outer edges and inwards again as a further lip, at another 90°, i.e. so as to be directed towards the base.

Such profiles have a good combination of resistance to load, e.g. torsion or buckling, with ease and uniformity of fabrication. Also, they can be used alone or in united pairs. Thus, it is known to fabricate an indoor temporary stage or mezzanine floor construction using a combination of single profiles, pairs of profiles united back to back, and if desired also pairs of profiles united mouth-to-mouth.

We have now investigated the use of these and like profiles in external building structures. External structures present different problems from mezzanine floors: they are bigger, they should be less internally obstructed, and they should possess an inclined roof support to fix a weather-layer. Also, they must be designed for varying loads, for example both positive wind pressure and negative wind pressure (suction) which can arise suddenly without warning,and for a uniformly or variably distributed snow loading. They must also form a basis for the attachment of a wall or roof weather layer itself resistant to such sudden and variable loads.

A major problem we encountered was in the fixing together of such profiles at angles, for example at the eaves or ridge of the roof. We have now however discovered a type of fixing bracket which in combination with two lengths of profile gives a strong and rigid connection of attractive appearance,with the additional advantage of using only a small number of bolt fixings.

In one aspect the invention consists of a fixing bracket for joining the ends of two lengths of cold-rolled metal channel each channel having a flat base with two longitudinal parallel strengthening grooves rolled into the thickness so as to protrude as longitudinal convex ribs within the channel;

(i) characterised in that the bracket is in the form of a metal sheet also having two parallel strengthening grooves formed in the thickness thereof so as to protrude as ribs on the reverse side of the sheet, each such groove extending from a first edge to a second edge of the sheet;(ii) the median line of the bracket grooves, (the median line lies halfway between the two grooves and is partly curved and partly straight), extends (a) as two end portions, inward in straight lines from the two said edges of the sheet, the said straight lines intersecting at a desired fixing angle (the angle between the straight parts of the grooves) and (b) as a communicating central portion, around an arc of a circle so as to connect the two straight lines;and (iii)the size and spacing of the bracket grooves are such that the bracket ribs fit into the concave channel. grooves, outside of the channel base;

whereby the end region of a first channel can be placed over one end portion of the bracket ribs and the end region of a second channel over the other end portion of the bracket ribs, with respective radially inner channel end corners adjacent, and fixed in relation to the bracket with the channels extending at the desired fixing angle.

In another aspect the invention consists in a cold-rolled steel portal frame structure, of the type in which a building of any desired length is built up from parallel transverse structural elements each comprising side columns and rafters, one rafter being attached to the top of each column and the rafters being mutually attached at the roof ridge; in which the columns and rafters all have a like profile consisting of two identical channel-shaped cold-rolled steel profiles back to back.

Preferably, the structure further comprises horizontal purlins between adjacent parallel rafters and optionally horizontal side rails between adjacent parallel columns, each of which has a profile identical with one of the two channel-shaped column or rafter components.

Preferably, moreover, the joining of columns or rafters on the one hand to side rails or purlins on the other is so effected that the side rail outer walls lie in the same plane as the column outer walls, and the purlin outer walls lie in the same plane as the rafter outer walls. For example, a right angle bracket attached wihin the base of the respective channels can be used.

It is particularly valuable if the rafters join the columns, or join each other, in such a way that the rafter and column ends viewed from within the structure (or two rafter ends viewed from within the structure) are essentially contiguous.

This can be achieved by suitable brackets e.g. as described above held at one end between the backs of the two column channels and at the other end between the backs of two rafter channels (or, at the apex, at each end between respective back to back pairs of rafter channels).

Preferred examples of such channels are those known under our Registered Trade Mark SWAGEBEAM, having a parallel pair of such grooves rolled along the base of the channel, and also having the upper edge of the channel walls deformed inwards at 90° and inwards again at 90°, to define a smooth channel edge.

The invention will be further described with reference to the accompanying drawings, in which.

Figure 1:
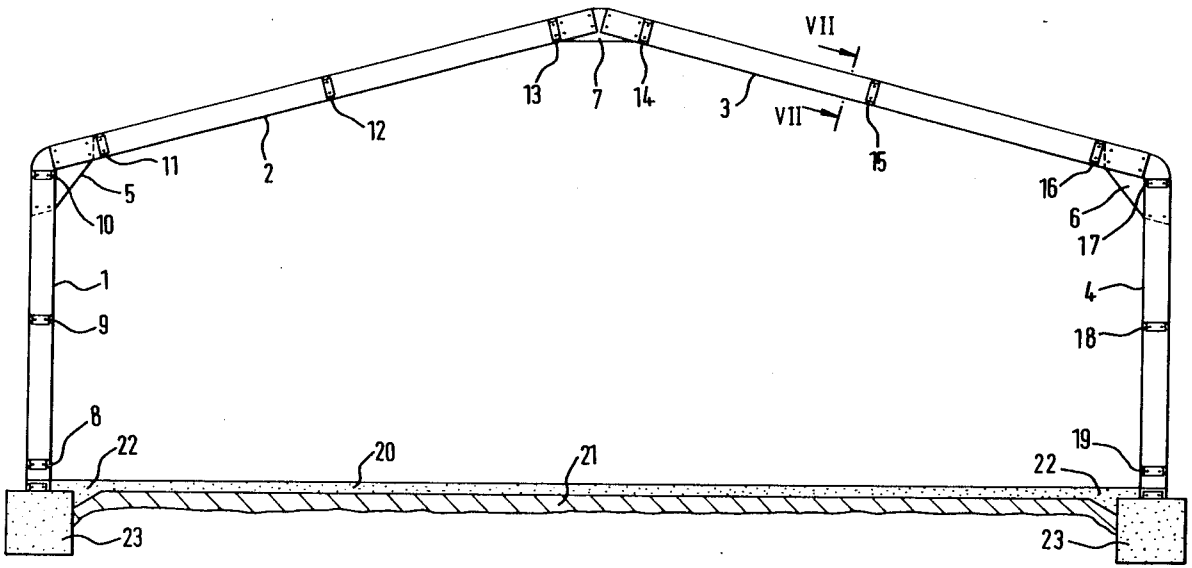
FIG. 1 is a transverse cross-section through a portal frame structure in accordance with the invention.

The portal frame structure as shown in cross-section in FIG. 1 consists essentially of a number of spaced transverse assemblies as shown joined by a plurality of horizontal members.

The transverse assembly shown in FIG. 1 consists of a side member or column 1, a rafter member 2, a further rafter member 3, and a further side member 4. Each of these elements of the transverse structure is composed of two identical channel-shaped members, of a nature described more fully below, bolted back-to-back. Thus the cross-sections of the members 1, 2, 3 and 4 are identical. Column 1 and rafter 2 are joined by an eaves bracket 5, described in more detail below, and column 4 and rafter 3 are joined by a like eaves bracket 6. The rafters 2 and 3 are joined by an apex or ridge bracket 7.

The transverse structure as shown is joined to its neighbouring transverse structures by side rails 8, 9 and 10 on column 1, purlins 11, 12, 13 on rafter 2, purlins 14, 15 and 16 on rafter 3, and side rails 17, 18 and 19 on column 4. In each instance, these elements are identical in length and profile, and are composed of a single channel-shaped unit identical in cross-section to half of the assembly constituted by the columns or rafters.

It will be appreciated therefore that the same cold-rolling mill can be used to fabricate all of the profiles described above, the profiles being cut to length and holed as necessary and bolted in assemblies in back to back pairs where necessary. (In practice, while the same rolling mill is used, it is preferably if a slightly thicker gauge of metal is used for the columns 1 and 4 than that used for the rafters 2 and 3 or for the individual side rails or purlins 8 to 19).

The total structure shown is of unusual and characteristic appearance, since the columns and rafters are joined essentially transverse edge to transverse edge at their inner surfaces. Moreover, there is no projection of side rails or purlins beyond the face of the adjacent columns or rafters respectively, which means that the structure can be clad in an economic fashion and can employ the well-known principles of "stressed skin design" to brace the structure to resist wind loads adequately.

While the support and floor of the structure is not itself a feature of the invention, it will be found convenient to excavate to a general level of say 250 mm, and to lay a 150 mm concrete floor slab 20 over 150 mm of random rubble 21. At the sides 22 of the portal frame the thickness of the floor slab can be increased to say 300 mm. Alternatively, if a floor is not required, each column itself can be supported upon a generally cubical block of concrete 23 of for example 600 mm edge length.

Figure 2:
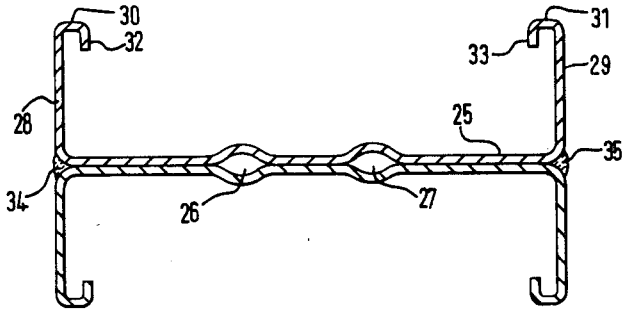
FIG. 2 is a cross-section through a cold-rolled profile used throughout the structure.

It is in usual practice intended that the structure should be composed of that profile known under the Registered Trade Mark SWAGEBEAM an example of which is shown in more detail in FIG. 2. FIG. 2 shows a typical SWAGEBEAM cross section, possessing a base 25, two grooves 26 and 27 rolled into the base so as to form convex ribs on the inner face of the channel, and channel walls 28 and 29 turned inwardly at right angles at their outer edges at 30, 31 respectively, and turned inwardly again at 32 and 33 at their innermost lips so as to be parallel to the side walls.

Two such profiles can be readily welded together as at 34 and 35 to give each of the members 1, 2, 3 and 4. A single profile, of course, exhibits the cross-section of any of the members 8 to 19.

Figure 3:
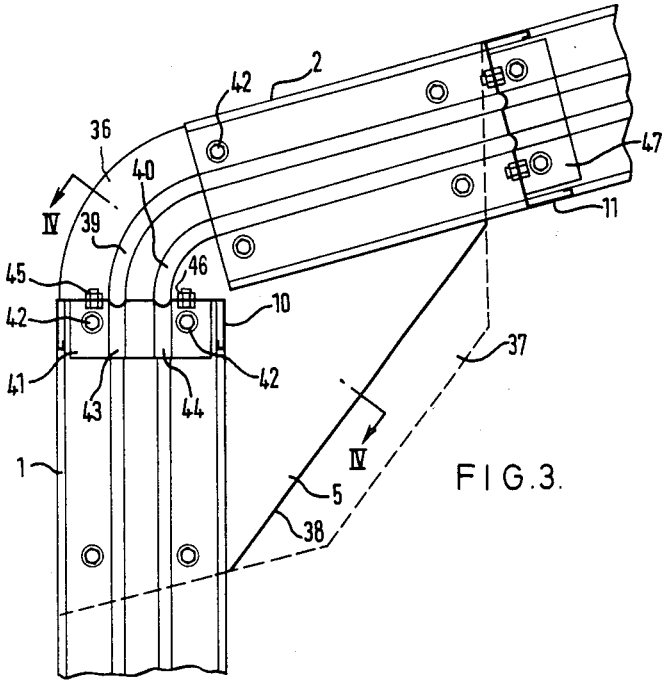
FIG. 3 is a general view of the eaves assembly of the structure.

A typical eaves assembly, located for example between the support column 1 and the rafter 2, is shown in FIG. 3. The bracket 5 is formed from an initially generally rhomboidal metal sheet, one corner of which is radiused as at 36(for strength and appearance), and the opposite corner of which is cut along a line 37, to give an edge which is eventually folded upwards at 38 along a predetermined line as a reinforcement against buckling. Into this metal plate are pressed two grooves 39 and 40,to give ribs on the otherside capable of generally fitting within grooves 26 and 27 of FIG. 2. These grooves 39, 40 extend along the sheet in from each edge (at a mutual angle which can be for instance 90° to 135°) and in a central portion are concentric with the radius of corner 36. Each limb of this bracket is provided with bolt holes as at 42. Normally, two such brackets, back to back, are fitted within two of the channel profiles as shown in FIG. 2, and assembled with bolts in suitably spaced bolt holes. Conveniently, when ends of adjacent profiles essentially coincide the assembly can be bolted together with one end of the fold 38 in each bracket more or less abutting one edge of the double-channel portion as a further stabiliding feature of the assembly. The ribs on the bracket fit within the relevant grooves 26 and 27 of the assembled column or rafter when these are doubled in the back-to-back assembly.

FIG. 3 also shows the assembly of a single profile to the paired profiles 1 or 2. Two examples of this single profile assembly are shown. For single profile 10 a right-angled fixing bracket 41 is placed with its bolt holes 42 in alignment with end (topmost) bolt holes of the pair or profiles constituting column 1 and in alignment with one of the inner pairs of bolt holes of the bracket. Usually there will be such a fixing bracket as 41 facing the other way on the other face of the bracket and column assembly also, unless the assembly is for one end only of the building construction. The various components are tightened together, and the right angle bracket which is itself grooved at 43 and 44 in the same manner as the profiles 1 and 10 and the eaves bracket 5 protrudes at right angles from the general plane of the bracket to provide a fixing location by means of bolts 45 and 46 for the side rail 10, the pattern of bolting being essentially as that shown for the rafters and columns.

The attachment of purlin 11 is similar, although in the instance shown, the right angle bracket 47 attaches only to the rafter 2 and in no way to the eaves bracket 5.

Figure 4:
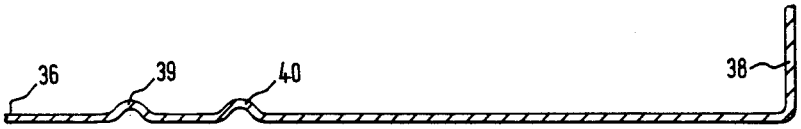
FIG. 4 is a cross-section along line IV—IV of FIG. 3.

FIG. 4 shows a section through a single eaves bracket along the line IV—IV of FIG. 3. It will be appreciated that the flap 38 of the bracket can be turned in either direction and that the grooves 39, 40 can have either orientation accordingly.

Figure 5:
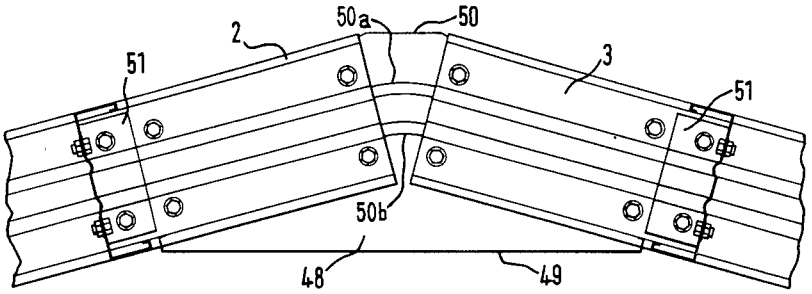
FIG. 5 is a general view of the ridge assembly of the structure.

FIG. 5 shows a ridge or apex assembly bracket. Typically, such brackets can be used for an included angle from very large angles (about 180° to 90°). Rafters 2 and 3 are connected by back-to-back brackets 48, with one edge folded up as at 49 (compare edge 38 of bracket 5) and with one edge cut straight across at 50. This pair of brackets is provided with grooves **50*a* and 50*b* to match the opposied grooves in the rafter members 2 and 3, as shown at 26 and 27 in FIG. 2. The nature of the assembly will be generally apparent from the assembly shown in FIG. 3. Once again, as with purlin 11, the right-angle fixing brackets (51** in this instance) do not pass over the bracket, but this is to some extent a matter of choice.

Figure 6:
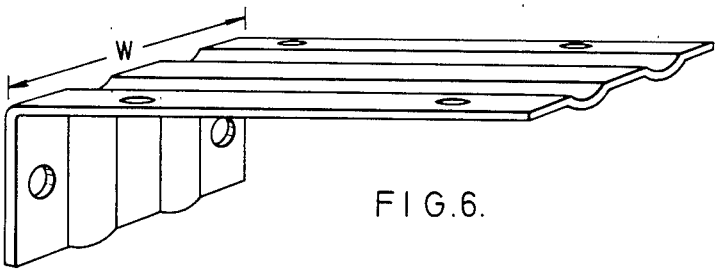
FIG. 6 is a general view of a right-angle assembly bracket.

FIG. 6 shows a general view of a right-angle bracket such as shown at 41 or 51. The width W of such a bracket is such that it can fit inside of the space defined between the inturned lips 32 and 33 as shown in FIG. 2. Moreover, in the bracket as shown in FIG. 6 grooves should both be in the same sense and so as to fit properly upon the convex sides of grooves 27 and 26 as shown in FIG. 2. Utilizing a fixing bracket as shown in FIG. 6, with appropriately spaced attachment points for bolting, can ensure that the purlin or side rail comes accurately up to the end of the inturned portions 30 and 31 of the channel shaped section thus giving a flat plane for the attachment of a weather layer, with consequent advantages of stressed skin action.

Figure 7:
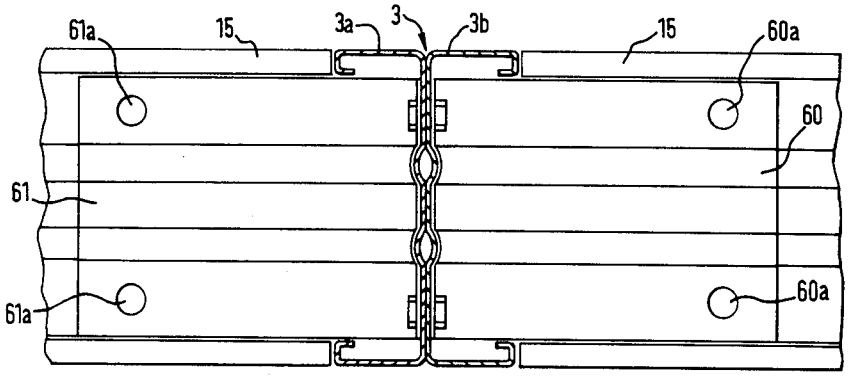
FIG. 7 is an enlarged section along the line VII—VII of FIG. 1.

FIG. 7 shows a section through line VII—VII of FIG. 1. A rafter 3 consists of two like profiles 3*a* and 3*b* fixed back-to-back. Two like right-angle brackets, (as shown in FIG. 6) fit one at each face, between inturned channel lips of the assembled profile, as shown, and are referenced at 60 and 61. They possess outer bolt holes 60*a* and 61*a*. To these are bolted in turn purlins such as 15, so as to extend one to either side of rafters 3 at right angles.

I claim:

1. In a roof construction, an eaves assembly comprising:

a rafter inclined to the horizontal, said rafter comprising two substantially identical channels located back-to-back, each of said channels having a flat base with two parallel strengthening grooves protruding as longitudinal ribs within each of said channels;

a support column for said rafter, said column comprising two substantially identical channels located back-to-back, said column having an upper end and a lower end; and an intermediate bracket connecting said rafter to said column, said bracket having an upper end and a lower end and formed as a sheet, said bracket including two spaced parallel grooves, each of said bracket grooves having a first straight end portion, a curved middle portion and a second straight end portion, said bracket grooves having a cross-section complementary to said rafter channel grooves, wherein said first straight end portions of said bracket grooves are disposed between said rafter channels, and wherein said second straight end portions of said bracket grooves are disposed between said support column channels, said rafter and said column being fixed to said intermediate bracket by a plurality of fixing members extending through said rafter channels and said bracket.

2. The assembly of claim 1, further comprising:

at least one side-rail member, said side-rail member including a channel having a cross-section substantially identical to the cross-section of said rafter channels and said support column channels, and at least one elongated fixing bracket having a first end, a second end and two spaced parallel grooves extending longitudinally thereon, each of said grooves having a cross-section complementary to that of said rafter channel grooves, said fixing bracket being bent at a right angle, wherein the first end of said fixing bracket is disposed within one end of said side-rail channel and wherein the second end of said fixing bracket is disposed within the upper end of said support column channel, said fixing members extending through said at least one fixing bracket and the lower end of said intermediate bracket.

3. The assembly of claim 1 or 2, wherein said rafter extends at an angle of less than 45° to the horizontal.

4. The assembly of claims 1 or 2, wherein said intermediate bracket has one edge which is arcuate.

5. The assembly of claims 1 or 2, wherein said intermediate bracket has an edge which is bent.

6. The assembly of claims 1 or 2 wherein rafter channels include vertical walls, inwardly rolled wall edges and inwardly rolled edge lips.

7. In a roof construction, a ridge assembly comprising:

a first rafter inclined to the horizontal, said rafter comprising two substantially identical channels located back-to-back, each of said channels having a flat base with two longitudinal parallel strengthening grooves protruding as longitudinal ribs within each of said channels;

a second rafter for attachment to said first rafter, said second rafter comprising two substantially identical channels located back-to-back; and an intermediate bracket for interconnecting said rafters, said intermediate bracket formed as a sheet, said bracket including two spaced parallel grooves, each of said bracket grooves having a first straight end portion, a curved middle portion and a second straight end portion, said bracket grooves having a cross-section complementary to said rafter channel grooves, wherein said first straight end portions of said bracket grooves are disposed between said first rafter channels, and wherein said second straight end portions are disposed between said second rafter channels, said rafters being fixed to said intermediate bracket by a plurality of fixing members extending through said rafter channels and said intermediate bracket.

8. The assembly of claim 7, wherein said rafters extend at an angle of less than 45° to the horizontal.

9. The assembly of claim 7, wherein said intermediate bracket has one edge which is arcuate.

10. The assembly of claim 7, wherein said intermediate bracket has an edge which is bent.

11. The assembly of claim 7, wherein said rafter channels include a vertical wall, inwardly rolled wall edges and inwardly rolled edge lips.

12. In a roof construction, an eaves assembly comprising:

a rafter inclined to the horizontal, said rafter comprising two substantially identical channels located back-to-back, each of said channels having a flat base with two longitudinal parallel strengthening grooves protruding as longitudinal ribs within each of said channels;

a support column for said rafter, said column comprising two substantially identical channels located back-to-back, said column having an upper end and a lower end;

an intermediate bracket connecting said rafter to said column, said bracket formed as a sheet, said bracket having an upper end and a lower end and including two spaced parallel grooves, each of said bracket grooves having a first straight end portion, a curved middle portion and a second straight end portion, said bracket grooves having a cross-section complementary to said rafter channel grooves, wherein said first straight end portions of said bracket grooves are disposed between said rafter channels, and wherein said second straight end portions of said bracket grooves are disposed between said support column channels, said rafter and said column being fixed to said intermediate bracket by a plurality of fixing members extending through said rafter channels and said bracket;

at least one side rail member, said side-rail member including a channel having a cross-section substantially identical to the cross-section of said rafter channels and said support column channels; and at least one elongated fixing bracket having a first end, a second end and two spaced parallel grooves extending longitudinally thereon, each of said grooves having a cross-section complementary to that of said rafter channel grooves, said fixing bracket being bent at a right angle, wherein the first end of said fixing bracket is disposed within one end of said side-rail channel and wherein the second end of said fixing bracket is disposed within the upper end of said support column channel, said fixing members extending through said at least one fixing bracket and the lower end of said intermediate bracket.

* * * * *